US011333150B2

(12) United States Patent
Ryu et al.

(10) Patent No.: US 11,333,150 B2
(45) Date of Patent: May 17, 2022

(54) COMPRESSOR

(71) Applicant: LG ELECTRONICS INC., Seoul (KR)

(72) Inventors: Gyeongjoong Ryu, Seoul (KR); Joo Youngse, Seoul (KR); Dong Gyu Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 175 days.

(21) Appl. No.: 16/841,841

(22) Filed: Apr. 7, 2020

(65) Prior Publication Data

US 2021/0054844 A1 Feb. 25, 2021

(30) Foreign Application Priority Data

Aug. 19, 2019 (KR) ..... 10-2019-0101400

(51) Int. Cl.

*F04C 29/12* (2006.01)
*F04C 18/02* (2006.01)
*F04C 29/06* (2006.01)

(52) U.S. Cl.

CPC ..... *F04C 29/12* (2013.01); *F04C 18/0215* (2013.01); *F04C 29/068* (2013.01); *F04C 29/126* (2013.01); *F04C 2250/102* (2013.01); *F04C 2270/13* (2013.01)

(58) Field of Classification Search

CPC .... F04C 18/0215; F04C 29/06; F04C 29/065; F04C 29/066; F04C 29/068; F04C 29/12; F04C 29/124; F04C 29/126; F04C 2250/102; F04C 2270/13; F04C 2270/14

See application file for complete search history.

(56) References Cited

U.S. PATENT DOCUMENTS 5,141,420 A 8/1992 Nambiar
5,649,816 A * 7/1997 Wallis ..... F01C 1/0215 417/313
5,921,761 A * 7/1999 Eckels ..... F04C 29/068 418/55.1

FOREIGN PATENT DOCUMENTS

KR 10-0516490 11/2005
KR 10-0609159 11/2005

(Continued)

OTHER PUBLICATIONS

Korean Office Action dated Sep. 28, 2020.

*Primary Examiner* — Mark A Laurenzi
*Assistant Examiner* — Xiaoting Hu
(74) *Attorney, Agent, or Firm* — Ked & Associates LLP

(57) ABSTRACT

A compressor may include a casing having a refrigerant inlet space therein that communicates with a suction pipe through which a refrigerant is suctioned into the casing; a high/low pressure separation plate that crosses an upper portion of a compression unit to partition the refrigerant inlet space positioned at a lower portion of the high/low pressure separation plate and a refrigerant discharge space positioned at an upper portion thereof; and a discharge guide. The discharge guide may be provided in the refrigerant discharge space and may be coupled with an upper surface of the high/low pressure separation plate to cover a communication hole of the high/low pressure separation plate that provides communication between the refrigerant inlet space and the refrigerant discharge space and at least a portion thereof may extend to a discharge pipe.

20 Claims, 9 Drawing Sheets

(56) References Cited

FOREIGN PATENT DOCUMENTS

| | | |
|---|---|---|
| KR | 10-2018-0065340 | 6/2018 |
| KR | 10-2018-0136775 | 12/2018 |

* cited by examiner

COMPRESSOR

CROSS-REFERENCE TO RELATED APPLICATION

The present application claims priority to Korean Patent Application No. 10-2019-0101400, filed Aug. 19, 2019 in Korea, the entire contents of which is incorporated herein for all purposes by this reference.

BACKGROUND

Technical Field

The present disclosure generally relates to a compressor. More particularly, the present disclosure relates to a compressor provided with a discharge guide guiding a flow path through which a compressed refrigerant is discharged.

Background

A compressor is a mechanical device used for producing high pressure or transferring a high-pressure fluid, and the compressor applied to a refrigeration cycle of a refrigerator or an air conditioner compresses a refrigerant and transfers the compressed refrigerant to a condenser. Such a compressor is typically classified into a reciprocating compressor, a rotary compressor, and a scroll compressor depending on a method of compressing a refrigerant gas.

The compressor compresses a refrigerant introduced to a compression chamber by using a rotational force of a motor and discharges the refrigerant. The compressed refrigerant is introduced to a refrigerant discharge space which is an inner space of an upper shell equivalent to a kind of a cover; is discharged to the outside through a discharge pipe; and is finally transferred to the condenser of a refrigeration cycle.

However, according to a conventional compressor, a refrigerant compressed in the compression chamber is dispersed in an entirety of the refrigerant discharge space and discharged through the discharge pipe. Accordingly, temperature and pressure of the refrigerant discharge space are very high, and temperature of the refrigerant is also maintained to be high.

Accordingly, the high temperature in the refrigerant discharge space deforms a high/low pressure separation plate which is a kind of partition dividing the refrigerant discharge space. The high/low pressure separation plate having a plate structure functions to separate the high pressure refrigerant discharge space from a low pressure refrigerant inlet space positioned thereunder and is deformed due to the high temperature of the refrigerant discharge space.

In addition, an upper portion (the refrigerant discharge space) of the inner space of the compressor has relatively high temperature and a lower portion (the refrigerant inlet space) thereof has relatively low temperature relative to the high/low pressure separation plate. This is because the compressed refrigerant is discharged to an upper space of the high/low pressure separation plate. When temperature difference between the upper space and a lower space is large, heat is transmitted to the lower space and the temperature of the lower space is increased. Accordingly, efficiency of the compressor is decreased.

DOCUMENT OF RELATED ART (Patent Document 1) Korean Patent Application Publication No. 10-2018-0136775

SUMMARY

Accordingly, the present disclosure has been made keeping in mind the above problems occurring in the related art, and the present disclosure is intended to propose a compressor, wherein a refrigerant discharged after being compressed in a compression chamber is directly guided to a discharge pipe before the refrigerant is entirely dispersed in a refrigerant discharge space.

The present disclosure is further intended to propose a compressor, wherein the compressed refrigerant is naturally guided to the discharge pipe.

The present disclosure is still further intended to propose a compressor, wherein rigidity of a high/low pressure separation plate is reinforced such that the high/low pressure separation plate is prevented from being deformed by high temperature.

In order to achieve the above objectives, according to one aspect of the present disclosure, there is provided a compressor including: a casing having a refrigerant inlet space therein communicating with a suction pipe suctioning a refrigerant; a high/low pressure separation plate provided by crossing an upper part of a compression unit to partition the refrigerant inlet space positioned at a lower portion of the high/low pressure separation plate and a refrigerant discharge space positioned at an upper portion thereof; and a discharge guide. In this case, the discharge guide is provided in the refrigerant discharge space and is combined with an upper surface of the high/low pressure separation plate to cover a communicating hole of the high/low pressure separation plate communicating the refrigerant inlet space with the refrigerant discharge space and at least a portion thereof extends to a discharge pipe such that the refrigerant discharged to the refrigerant discharge space is guided to the discharge pipe. Accordingly, a high temperature and pressure refrigerant discharged from the compression chamber may be guided to flow directly to the discharge pipe prior to being dispersed to an entirety of the refrigerant discharge space.

The discharge guide may include: a combination end combined with the upper surface of the high/low pressure separation plate by surrounding the communicating hole of the high/low pressure separation plate; a guide body connected to the combination end and defining a guide room therein by protruding upward from the combination end and covering the communicating hole of the high/low pressure separation plate; and a guide tunnel connected to the guide body and extending in a direction to the discharge pipe such that the refrigerant in the guide room is guided to the discharge pipe. Accordingly, an inner part of the refrigerant discharge space may be prevented from being excessively heated or pressurized.

In this case, the guide tunnel of the discharge guide and the discharge pipe may be spaced apart from each other and a dispersion space may be provided therebetween. The dispersion space may prevent noise in the discharge pipe which may occur due to the refrigerant rapidly flowing only along the discharge guide.

The guide body of the discharge guide may protrude toward a lower surface of an upper shell of the casing with the communicating hole of the high/low pressure separation plate facing a center part thereof, wherein a height of the center part provided by extending from a vicinity of the communicating hole may be configured to be the highest. Due to such a structure, the guide body may have high durability against high pressure.

In addition, a lower part of the guide tunnel may be open to the upper surface of the high/low pressure separation plat, and an inclined part connecting an end part of the guide tunnel with an entrance of the discharge pipe therebetween may be provided on the upper surface of the high/low pressure separation plate equivalent to the lower part of the guide tunnel such that the refrigerant may be naturally guided to the discharge pipe.

The guide body and the guide tunnel may be provided as a continuous curved or inclined surface. Accordingly, there may be no dead space in the guide room, and stress may be prevented from being concentrated on the discharge guide.

In addition, a diameter of the guide tunnel of the discharge guide may be larger than a diameter of a circle defined by valve holes of a check valve opposed thereto. Accordingly, the refrigerant may be efficiently discharged.

Furthermore, a reinforcement rib of a circular shape may be provided on the high/low pressure separation plate by surrounding the communicating hole relative thereto and protruding upward from the high/low pressure separation plate, and when the combination end of the discharge guide is combined with an outer surface of the reinforcement rib, rigidity of the vicinity of the communicating hole may be reinforced.

The compressor according to the present disclosure, which is described above, has the following effects.

In the present disclosure, the discharge guide is provided in the refrigerant discharge space and guides the high temperature and pressure refrigerant discharged from the compression chamber such that the high temperature and pressure refrigerant flows directly to the discharge pipe prior to being dispersed to an entirety of the refrigerant discharge space. In this case, an inner part of the refrigerant discharge space is prevented from being excessively heated and having an excessively high pressure. Accordingly, efficiency of the compressor is improved. Particularly, temperature of an entire inner part of the compressor to a lower part thereof is decreased and an input value (power consumption) of the compressor decreases. Accordingly, efficiency of the compressor is improved.

Furthermore, the high/low pressure separation plate is prevented from being deformed due to high pressure in the refrigerant discharge space. Accordingly, durability of the compressor is improved.

In addition, the discharge guide constituting the present disclosure defines a continuous flow path from the communicating hole connected to the compression chamber to the entrance of the discharge pipe. Accordingly, a refrigerant is naturally discharged. Such efficient flow of the refrigerant enhances efficiency of the compressor.

However, the discharge guide of the present disclosure is not directly connected to the entrance of the discharge pipe but is spaced apart to some degree therefrom, and accordingly, a portion of the refrigerant is dispersed to a space spaced apart between the discharge guide and the discharge pipe. Accordingly, noise in the discharge pipe, which may occur due to the refrigerant rapidly flowing only along the discharge guide, is prevented. Furthermore, excessive high temperature and pressure of the refrigerant discharge space is prevented, and discharge of the refrigerant is prevented from being excessively concentrated in the discharge pipe so that noise and vibration therein are decreased.

Furthermore, the discharge guide of the present disclosure is combined with the high/low pressure separation plate, which is plate-shaped, particularly, by covering a vicinity of the communicating hole in which rigidity of the high/low pressure separation plate is relatively low. Accordingly, the discharge guide reinforces the rigidity of the high/low pressure separation plate and prevents the high/low pressure separation plate from being deformed by the high pressure refrigerant.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
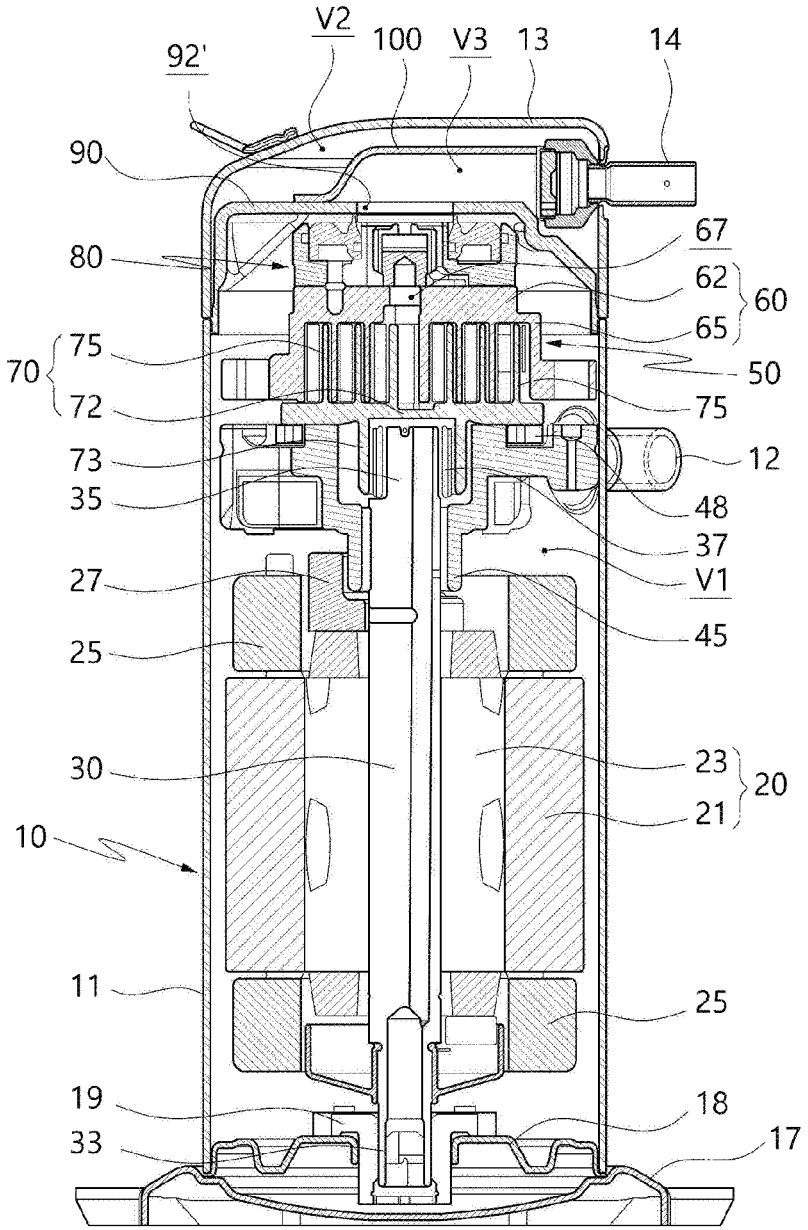
FIG. 1 is a sectional view illustrating configuration of a compressor according to an embodiment of the present disclosure.

Exemplary embodiments of the present disclosure will be described in detail with reference to the accompanying drawings. Throughout the drawings, the same reference numerals will refer to the same or like parts. In addition, in the following description of the present disclosure, it is to be noted that, when the functions of conventional components and the detailed description of components related with the present disclosure may make the gist of the present disclosure unclear, a detailed description of those components will be omitted.

Furthermore, in the description of the components of the embodiments of the present disclosure, terms such as first, second, A, B, (a), and (b) can be used. These terms are only for distinguishing the components from other components, and the nature or order of the components is not limited by the terms. When a component is described as being "connected", "coupled", or "connected" to other components, that component may be directly connected to or combined with the other components, but it should be understood that still other components may be "connected", "coupled" or "combined" between each of the components.

A compressor according to the embodiment of the present disclosure may include a casing 10, a driving unit 20, a compression unit 50, and a rotating shaft 30, wherein an upper portion of the compression unit 50 may include a high/low pressure separation plate 90 and a discharge guide 100. Such a structure will be described again hereinbelow.

For reference, although a scroll compressor is illustrated as an example hereinbelow, the compressor of the present disclosure may be applied to a rotary compressor or a swash plate type compressor. That is, the compressor of the present disclosure may be applied to the driving unit 20 (a motor), the rotating shaft 30 rotated by the driving unit 20, and various compressors including the compression unit 50 having volume of the compression chamber changed by the rotating shaft 30.

First, the casing 10 constitutes an outer surface of the compressor and may have an inner space V1 therein. Components allowing the compressor to be operated are installed in the inner space V1. The casing 10 may include a body shell 11 having a shape of a cylinder being open upward and downward, an upper shell 13 covering an upper portion of the body shell 11, and a lower shell 17 covering a lower portion of the body shell 11. The body shell 11 and the upper shell 13, and the body shell 11 and the lower shell 17 are fixed to each other by welding.

The inner space V1 may be the refrigerant inlet space V1 to which the refrigerant is introduced, and the refrigerant may be introduced through a suction pipe 12 provided in the body shell 11 to the refrigerant inlet space V1. The refrigerant inlet space V1, which is a lower pressure part, and a refrigerant discharge space V2, which is a high pressure part are divided by the high/low pressure separation plate 90 installed at an upper side of the inner space.

Here, the refrigerant inlet space V1 may be a space of a lower side of the high/low pressure separation plate 90 and the refrigerant discharge space V2 may be a space of an upper side of the high/low pressure separation plate 90. The upper shell 13 may include a discharge pipe 14 communicating with the refrigerant discharge space V2 and discharging a refrigerant to the outside. The discharge pipe 14 may be connected to a condenser (not shown) of a refrigeration cycle such that the refrigerant is transferred to the condenser.

The refrigerant inlet space V1 may include the driving unit 20 therein. The driving unit 20 generates a rotational force and rotates the rotating shaft 30. In the embodiment, the driving unit 20 is arranged at a side lower than the compression unit 50. Contrarily, the compression unit 50 may be arranged at a side lower than the driving unit 20.

The driving unit 20 is largely composed of a rotor 21 and a stator 23. Here, the rotor 21 and the stator 23 are components rotating relatively to each other, wherein the stator 23 is provided by being fixed on an inner circumferential side of the casing 10 and the rotor 21 is rotatably provided in the stator 23. Here, the stator 23 may include stator cores, which are multiply laminated, and a coil 25 wound on the stator cores. Alternatively, the rotor 21 may include the stator cores and the coil 25 wound on the stator cores.

Meanwhile, the rotor 21 may be provided with a balance weight 27. Accordingly, although the rotating shaft 30 includes an eccentric portion, the rotor 21 can rotate stably.

The stator 23 is fixed to an inner wall surface of the casing 10 by shrink-fitting, and the rotating shaft 30 is inserted into a center portion of the rotor 21. The rotating shaft 30 functions to transmit the rotational force to an orbiting scroll 70 of the compression unit 50 while rotating with the rotor 21. The rotating shaft 30 extends in a vertical direction of the compressor.

A lower end part 33 of the rotating shaft 30 is rotatably supported by a lower bearing 19 installed at a lower part of the casing 10. The lower bearing 19 is supported by a lower frame 18 fixed to the inner wall surface of the casing 10 and can stably support the rotating shaft 30. The lower frame 18 may be fixed to the inner wall surface of the casing 10 by welding and a bottom surface of the casing 10 may be used as an oil storage space. Oil stored in the oil storage space is transferred to an upper side of the casing by the rotating shaft 30 and enters the driving unit 20 and the compression chamber of the compression unit 50 such that the driving unit and the compression chamber are lubricated.

An upper end part 34 of the rotating shaft 30 is rotatably supported by a main frame 40. The main frame 40 may be fixed to the inner wall surface of the casing 10 as the lower frame 18 and may include an upper bearing 45 provided at a lower surface thereof by protruding downward therefrom. The upper end part of the rotating shaft 30 is fitted into the upper bearing 45, and the main frame 40 and the upper bearing 45 are fixed. As the rotating shaft 30 rotates, the upper bearing 45 rotates relatively to the rotating shaft while in close contact with the upper end part of the rotating shaft 30.

Meanwhile, the compression unit 50 functions to compress a refrigerant while being rotated by the rotating shaft 30 in the inner space V1 of the casing 10. In the embodiment, the compression unit 50 may include two relatively rotating components, that is, a fixed scroll 60 and the orbiting scroll 70. The orbiting scroll 70 changes volume of the compression chamber existing between the orbiting scroll and the fixed scroll 60 while being rotated by being engaged with an eccentric protrusion part 35 protruding from the upper end part of the rotating shaft 30, and in this process, the refrigerant in the compression chamber is compressed and discharged.

As for a combined structure of the compression unit 50 and the rotating shaft 30 prior to a detailed description of the compression unit 50, a combination part 73 is provided on a lower surface of an orbiting plate 72 of the orbiting scroll 70 and a combination space is provided inside the combination part 73. A slide bush 37 is fitted into the combination space and the eccentric protrusion part 35 of the rotating shaft 30 is fitted into the slide bush 37.

Although the slide bush 37 moves relatively to the eccentric protrusion part 35 of the rotating shaft 30 while sliding along a straight path thereof, the slide bush moves relatively to the orbiting scroll 70 while sliding in a circumferential direction thereof. As for the configuration of the slide bush, the slide bush 37 may be configured to have a roughly cylindrical shape and to include a slide space 39 at a center thereof by being formed therethrough in a vertical direction. Although the eccentric protrusion part 35 is fitted into the slide space 39, the eccentric protrusion part and the slide bush are not rotated relatively to each other.

The fixed scroll 60 and the orbiting scroll 70 rotate while being in contact with each other. More particularly, the orbiting scroll 70 changes the volume of the compression chamber while orbiting without rotating on an axis thereof. First, as the fixed scroll 60 is illustrated, the fixed scroll 60 may include a disc-shaped fixed plate 62 provided at an upper part thereof and a fixed wrap 65 provided by protruding downward from the fixed plate 62. The fixed wrap 65 may be configured to have a spiral shape so as to be engaged with an orbiting wrap 75 of the orbiting scroll 70, which will be described hereinbelow, wherein an inlet hole into which the refrigerant existing in the refrigerant inlet space V1 is sucked is provided on a side surface of the fixed wrap. Furthermore, a discharge hole 67 through which the compressed refrigerant is discharged may be provided at a center of the fixed scroll 60.

As the orbiting scroll 70 is illustrated, the orbiting scroll 70 may include the orbiting plate 72, which is roughly disc-shaped, and the orbiting wrap 75, which is spirally shaped, protruding from the orbiting plate 72 in a direction to the fixed plate 62. The orbiting wrap 75 defines the compression chamber in cooperation with the fixed wrap 65.

The orbiting plate 72 of the orbiting scroll 70 orbits while being supported by an upper surface of the main frame 40, and an Oldham ring 48 is installed between the orbiting plate 72 and the main frame 40 and prevents the orbiting scroll 70 from rotating on the axis thereof. In addition, the combination part 73, which is roughly ring shaped, is provided on a lower surface of the orbiting plate 72 of the orbiting scroll 70 by protruding therefrom such that the eccentric protrusion part 35 of the rotating shaft 30 is inserted thereinto. This allows the orbiting scroll 70 to be orbited by the rotational force of the rotating shaft 30. More particularly, the slide bush 37 is positioned between the eccentric protrusion part 35 and the combination part 73.

A back pressure assembly 80 is installed at an upper part of the compression unit 50. Particularly, the back pressure assembly 80 may be installed at an upper side of the fixed plate 62 of the fixed scroll 60, have a frame of a roughly ring-shaped body, and may contact with the fixed scroll 60.

The back pressure assembly 80 may include a back chamber plate 82 combined with an upper part of the fixed scroll 60 and a back chamber piston 85 moving in upward and downward directions relative to the back chamber plate 82. The back chamber piston 85 moves upward in a compression process by the compression unit 50 and functions to partition a low pressure part positioned at an inner side of the back pressure assembly 80 and a high pressure part positioned at an outer side of the back pressure assembly 80. Reference numeral 87 refers to a back pressure hole communicating with the discharge hole 67 of the fixed scroll 60, and the back pressure hole 87 communicates with the refrigerant discharge space V2 through a communicating hole 92' of the high/low pressure separation plate 90.

The high/low pressure separation plate 90 is provided at an upper side of the back pressure assembly 80. The high/low pressure separation plate 90 partitions the refrigerant inlet space V1, which is a low pressure part, and the refrigerant discharge space V2, which is a high pressure part, and may be installed to cross the upper side of the compression unit 50. The high/low pressure separation plate 90 may be configured to have a roughly thin plate shape, and the refrigerant discharge space V2, which is a high pressure part, is provided on the upper surface thereof. Accordingly, a downward high pressure is applied to the high/low pressure separation plate. Accordingly, it is important that the high/low pressure separation plate 90 is prevented from being deformed by the high pressure. As is described hereinbelow, the present disclosure may have a structure allowing this to be prevented.

Figure 3:
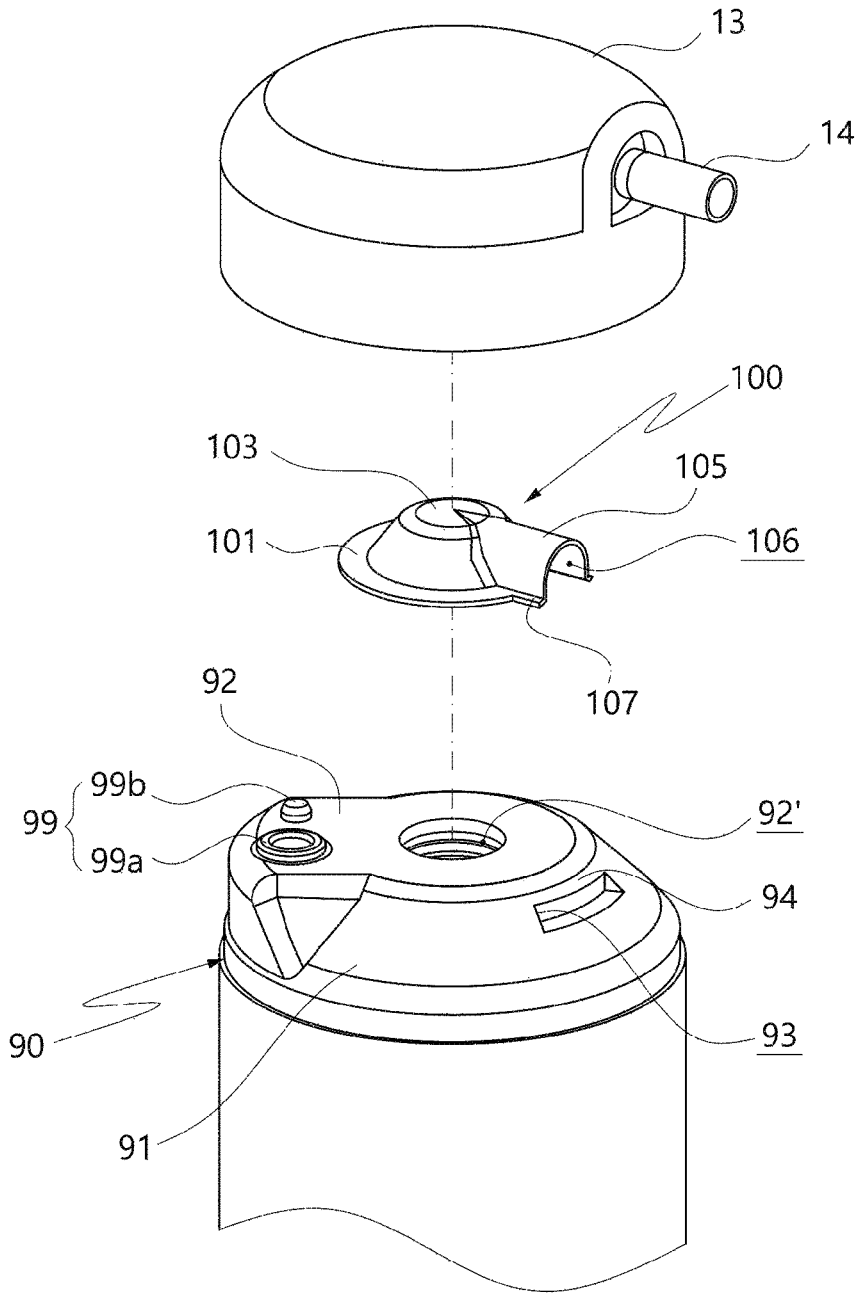
FIG. 3 is an exploded perspective view illustrating the configuration of FIG. 2.

A structure of the high/low pressure separation plate 90 is illustrated in FIG. 3. As illustrated in FIG. 3, the high/low pressure separation plate 90 may have a partition body 91 constituting a frame thereof, wherein the partition body 91 may have a shape having a width gradually narrowing toward an upper part thereof and an upper surface 92 of the partition body is flat. The communicating hole 92' is provided at a center portion of the upper surface 92. The communicating hole 92' communicates with the discharge hole 67 of the fixed scroll 60 and with the back pressure hole 87 of the back pressure assembly 80, which are described above.

Figure 4:
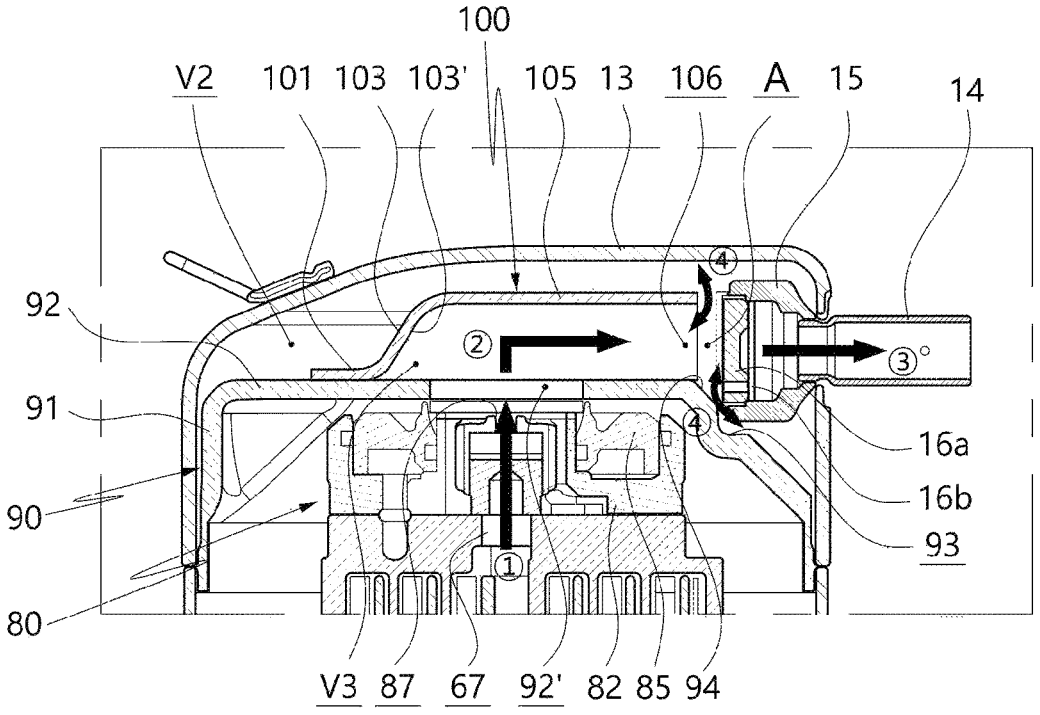
FIG. 4 is a sectional view illustrating an inner configuration of FIG. 2.

An evasion groove 93 may be provided at a side of the partition body 91 and have a shape depressed to an inside thereof. The evasion groove 93 provided under the discharge pipe 14 is a part preventing the partition body from being interfered by a check valve 15 constituting an inner side of the discharge pipe 14. Referring to FIG. 4, a lower part of the check valve 15 provided at the inner side of the discharge pipe 14 is seen to be positioned at the evasion groove 93. An inclined part 94 is provided at an upper side of the evasion groove 93 and an inclined surface thereof functions to induce refrigerant flow in a direction of the check valve 15. This will be described again hereinbelow.

The partition body 91 may include protecting means 99 provided on the upper surface 92 thereof. When the refrigerant discharge space V2 is excessively high in temperature or pressure, the protecting means 99 mitigates the high temperature or pressure and may include a high pressure prevention valve 99*a* and a high temperature prevention sensor 99*b*. The high pressure prevention valve 99*a* is a kind of a bypass structure which functions to lower the pressure of the refrigerant discharge space V2 by being opened when the refrigerant discharge space V2 reaches at least a predetermined pressure. Furthermore, when the refrigerant discharge space V2 reaches at least a predetermined temperature, the high temperature prevention sensor 99*b* is opened and functions to lower the temperature of the refrigerant discharge space V2, and is provided as a bimetal in the embodiment. The protecting means 99 may be omitted.

Next, as for the discharge guide 100, the discharge guide 100 is installed in the refrigerant discharge space V2 and functions to guide a refrigerant to the discharge pipe 14. To this end, in the embodiment, the discharge guide 100 is combined with the upper surface of the high/low pressure separation plate 90 so as to cover the communicating hole 92' of the high/low pressure separation plate 90 communicating the refrigerant inlet space V1 with the refrigerant discharge space V2, wherein a portion of the discharge guide extends to the discharge pipe 14.

To describe the discharge guide 100 more particularly, the discharge guide 100 is a component independent of the high/low pressure separation plate 90 and is combined with the upper surface of the high/low pressure separation plate 90 and partitions the refrigerant discharge space V2. A guide room V3 is provided in an inner side of the discharge guide 100 relative to the discharge guide 100 and accordingly, may be considered to partition the refrigerant discharge space V2.

Figure 2:
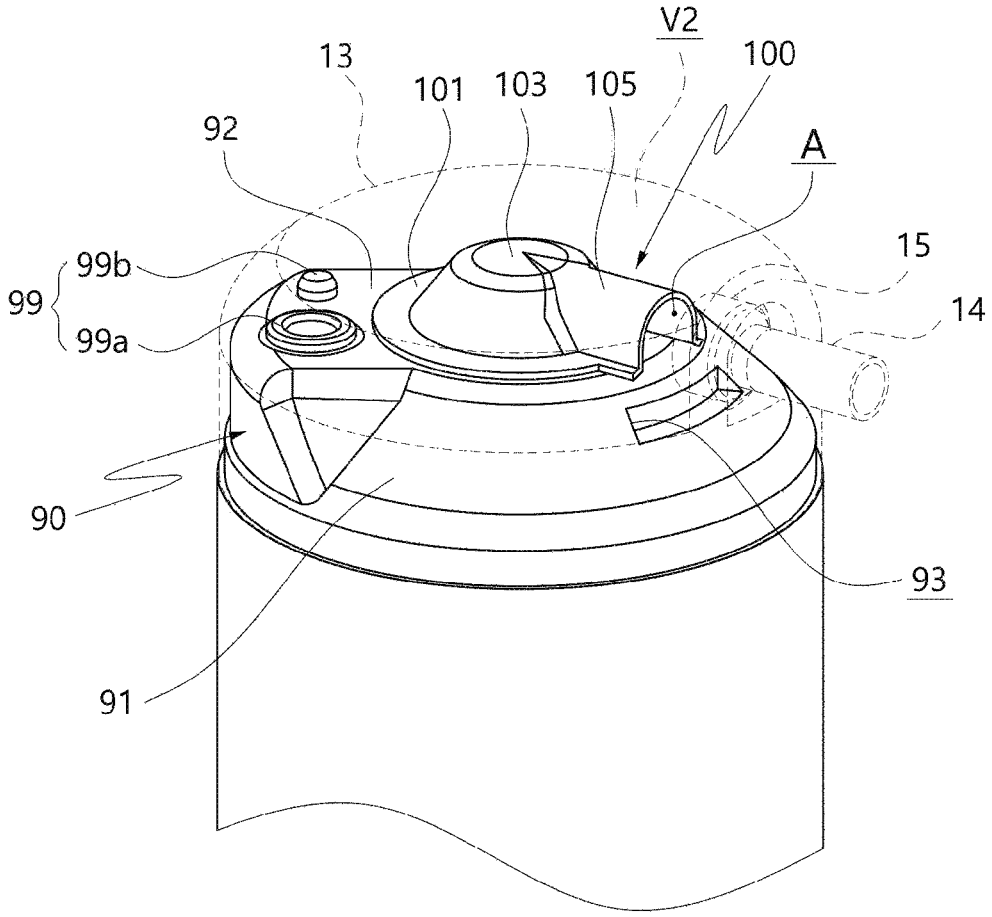
FIG. 2 is a perspective view illustrating an upper structure including a refrigerant discharge space in the embodiment of FIG. 1.

A structure of the discharge guide 100 is illustrated in FIGS. 2 and 3. Accordingly, the discharge guide 100 may be made of a thin plate-shaped metal and may include the guide room V3, which is an empty space, at the inner side thereof by being open downward. When the discharge guide 100 is combined with the high/low pressure separation plate 90, a lower side of the guide room V3 is blocked by the upper surface 92 of the high/low pressure separation plate 90 and communicates with the communicating hole 92' of the high/low pressure separation plate 90. Accordingly, a high temperature and pressure refrigerant discharged through the communicating hole 92' is introduced first to the guide room V3.

The discharge guide 100 may include a combination end 101. The combination end 101 is formed by surrounding a lower edge of the discharge guide 100 and is a part combined with the high/low pressure separation plate 90. The combination end 101 may be combined with the high/low pressure separation plate 90 by welding or by using an additional fastener such as a rivet. In the embodiment, the combination end 101 may have a roughly circular shape by surrounding the vicinity of the communicating hole 92' and a lower surface thereof may have a plane shape corresponding to the upper surface 92 of the high/low pressure separation plate 90.

A guide body 103 may be connected to the combination end 101. The guide body 103 extends by protruding upward from the combination end 101 and defines the guide room V3 at an inner side thereof. The guide body 103 defines the guide room V3 therein by protruding upward from the combination end and covering the communicating hole 92' of the high/low pressure separation plate 90. The guide body 103 may be formed in various shapes. However, according to the embodiment, the guide body 103 of the discharge guide 100 protrudes from the high/low pressure separation plate to have a width gradually narrowing upward, and a portion of an upper surface of the discharge guide may have a plane shape.

More particularly, the guide body may have a shape of a cap having a lower portion of a circular shape. That is, as for the guide body alone, the guide body may have a roughly circular shape at a lower side thereof and have the width gradually narrowing toward an upper side of the guide body from the lower side thereof. The lower side of the guide body may have a circular shape or an oval shape and the upper side thereof may have the same shape as or a shape different from the shape of the lower side, but the width of the guide body gradually narrows upward.

Figure 5:
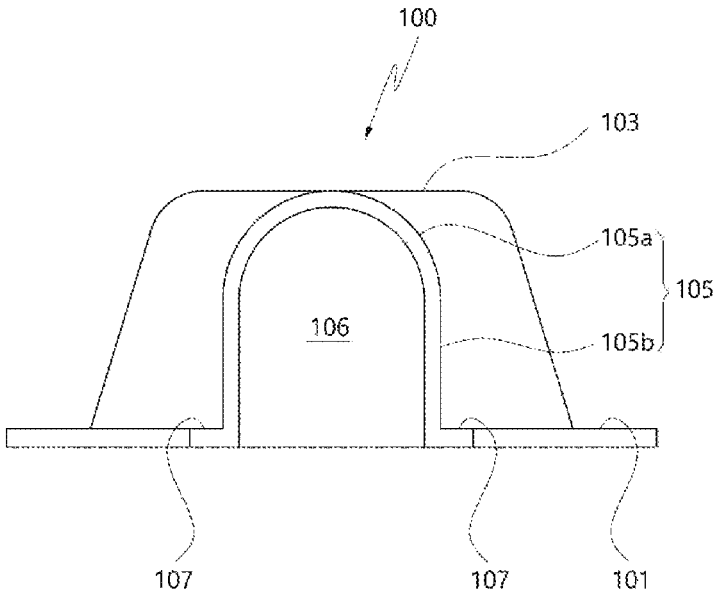
FIG. 5 is a front view of a discharge guide according to the embodiment of FIG. 1 shown from a front of a guide tunnel.

A guide tunnel 105 extends from a side of the guide body 103. A first side of the guide tunnel 105 is integrally connected to the guide body 103 and a second side of the guide tunnel, which is opposite to the first side, extends in a direction to the discharge pipe 14, so that a refrigerant is induced to the discharge pipe 14. As illustrated in FIGS. 4 and 5, the guide tunnel 105 defines a connecting space 106 therein and the connecting space 106 communicates with the guide room V3. That is, a side surface of the guide body 103 is open and communicates with the connecting space 106 of the guide tunnel 105. Fixing end parts 107 combined with the upper surface 92 of the high/low pressure separation plate 90 are provided at lower sides of the guide tunnel 105.

Referring to FIG. 5, a shape of a transverse section of the guide tunnel 105 may include an upper section 105*a* of an arc or elliptical arc shape and a lower section 105*b* straightly extending from each of opposite ends of the upper section 105*a* toward the high/low pressure separation plate 90. The upper section 105*a* is a part covering the connecting space 106 and the lower section 105*b* is a part further extending therefrom to the high/low pressure separation plate 90. Here, the lower section 105*b* may be continuously connected to each of the fixing end parts 107, and the fixing end part 107 may be considered to be a part of the lower section 105*b*.

A width of the guide tunnel 105 is narrower than the entire width of the guide body 103, and due to such a shape, a refrigerant is guided to be concentrated in a specific direction, that is, toward the discharge pipe 14. In the embodiment, the guide tunnel 105 may have a predetermined width and alternatively, may have a left to right width gradually narrowing toward an end part thereof to the discharge pipe 14, or may have a height gradually lowering toward the discharge pipe 14.

Referring to FIG. 4, a lower part of the guide tunnel 105 is open to the upper surface 92 of the high/low pressure separation plate 90. Accordingly, the high/low pressure separation plate 90 can be considered to define the guide room V3 and the connecting space 106 in cooperation with the discharge guide 100. Alternatively, the discharge guide 100 may include an additional lower plate, and a hole communicating with the communicating hole 92' of the high/low pressure separation plate 90 may be formed through a center of the lower plate.

The guide body 103 and the guide tunnel 105 are configured to have a continuous curved or inclined surface. A side surface of the guide body 103 may have a shape of a curved surface provided by naturally extending from the combination end 101 and only a portion of an upper surface of the guide body may have a plane shape. As illustrated in FIG. 3, when the guide tunnel is seen from a direction of an exit of the connecting space 106, the guide tunnel 105 may have a roughly semi-circular shape and accordingly, an outer surface thereof may have a curved surface structure.

Accordingly, since the entirety of the discharge guide 100 is configured to have a curved surface or an inclined surface, there is no dead space in the guide room V3 and the connecting space 106 of an inner part of the discharge guide, and vortices, which may be caused by an edge structure, can be prevented. Furthermore, the structure having such a curved surface or inclined surface prevents stress from being concentrated on the discharge guide 100 and thus also functions to enhance durability. Since the refrigerant discharge space V2 is fundamentally filled with high pressure refrigerants, the discharge guide 100 is greatly pressed. However, the structure of the curved surface or the inclined surface of the discharge guide 100 enhances durability thereof such that the discharge guide is prevented from being deformed.

As illustrated in FIGS. 2 and 4, the guide tunnel 105 of the discharge guide 100 is spaced apart from the discharge pipe 14. The guide tunnel 105 is spaced apart from the discharge pipe 14 without being directly connected thereto, and accordingly, there is a dispersion space A therebetween. A portion of a refrigerant passing through the guide tunnel 105 may escape through the dispersion space A, or contrarily, a refrigerant in the refrigerant discharge space V2 may be introduced into the dispersion space A. An arrow of FIG. 4 indicates flow of a portion of a refrigerant caused by the dispersion space A.

The dispersion space A disperses a portion of a refrigerant. Accordingly, noise which may occur while the refrigerant rapidly flows only along the discharge guide 100 into the discharge pipe 14 is prevented from occurring in the discharge pipe 14. More particularly, when the refrigerant is concentrated all at once, a valve plate 16*b*, which constitutes the check valve 15 of the discharge pipe 14, may move at a high speed and generate noise inside the discharge pipe 14. However, the noise is prevented to some extent by the dispersion space A.

Preferably, a distance (mm) spaced apart between the guide tunnel 105 of the discharge guide 100 and the discharge pipe 14 by the dispersion space A is equivalent to 1% to 4% of a value of a transverse sectional-area ($mm^2$) of the guide tunnel 105. Here, the area of the guide tunnel 105 refers to a transverse sectional-area of the connecting space 106.

Figure 9:
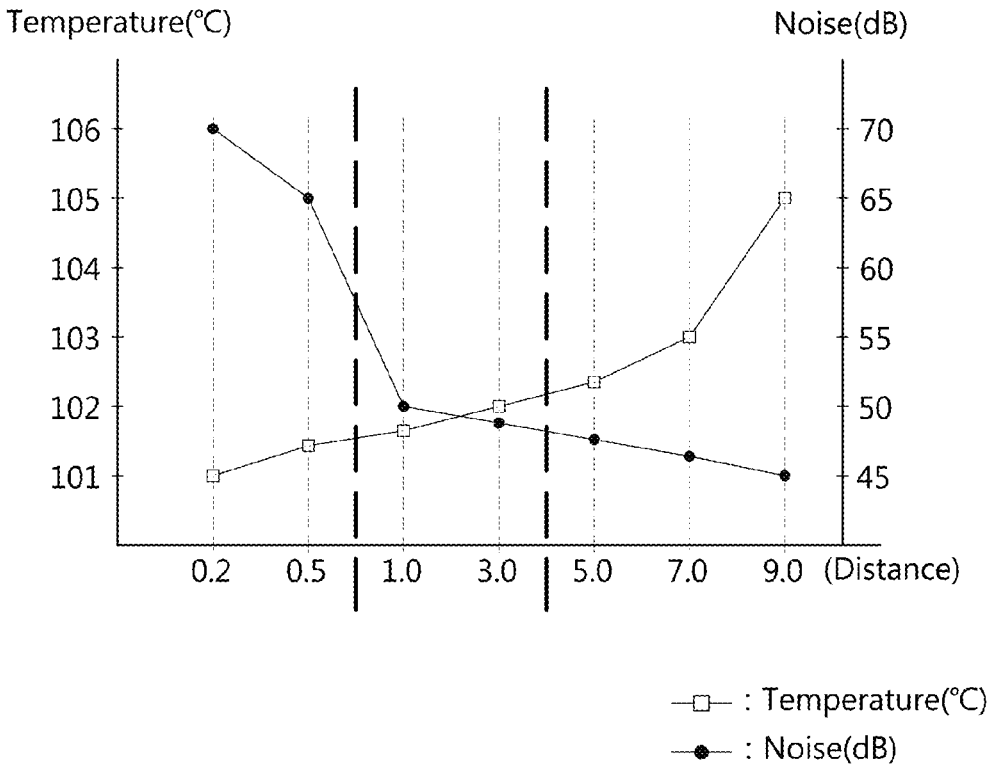
FIG. 9 is a graph illustrating results of measuring noises and temperatures generated as a distance of a dispersion space to a value of an area of the guide tunnel is changed in the present disclosure.

FIG. 9 is a graph illustrating results of measuring noises and temperatures generated as the distance of the dispersion space A to the value of the area of the guide tunnel 105 is changed. Here, each of the noises refers to a measured value of magnitude of a noise produced when output of the compressor is maximized, and each of the temperatures refers to a measured value of temperature of the refrigerant discharge space V2. A horizontal axis represents the ratio of the distance (mm) of the dispersion space A to the value of the area ($mm^2$) of the guide tunnel.

As illustrated in the graph, when the ratio of the distance of the dispersion space A to the value of the area of the guide tunnel 105 is less than 1.0%, the noise is equal to or more than 60 db, whereas when the ratio is 1.0% or more, the noise is greatly reduced to 50 db or less due to the refrigerant dispersed by the dispersion space A.

Meanwhile, when the ratio of the distance of the dispersion space A to the value of the area of the guide tunnel 105 is less than 1.0%, the temperature of the refrigerant discharge space V2 is 102° C. or lower, whereas when the ratio is 3.0% or more, the temperature increases to 103° C. or higher. When the distance of the dispersion space A is short, an amount of the refrigerant dispersed by the dispersion space A decreases. Accordingly, the temperature of the refrigerant discharge space V2 is effectively lowered.

As a result, when the two conditions are considered, the distance spaced apart between the guide tunnel 105 of the discharge guide 100 and the discharge pipe 14 by the dispersion space A is preferably 1%~4% of the value of the area of the guide tunnel 105. In the embodiment, a diameter of the inner part of the guide tunnel 105 is 20.8 mm, and an area thereof is 300 $mm^2$. Accordingly, the distance of the dispersion space A compared to the value of the area of the guide tunnel 105 ranges from 3 mm to 12 mm.

Meanwhile, the inclined part 94, which is described above, is located on the upper surface of the high/low pressure separation plate 90 equivalent to the lower part of the guide tunnel 105. The inclined part 94 connects an end part of the guide tunnel 105 with an entrance of the discharge pipe 14 therebetween and is configured to be inclined downward. The inclined part 94 is provided at a position adjacent to the evasion groove 93 of the high/low pressure separation plate 90, which is described above, and is provided between the upper surface 92 of the high/low pressure separation plate 90 and the evasion groove 93. A refrigerant flowing between the upper surface 92 of the high/low pressure separation plate 90 and the connecting space 106 may be naturally induced along the inclined part 94 to the entrance of the discharge pipe 14, that is, to the check valve 15.

Figure 6A:
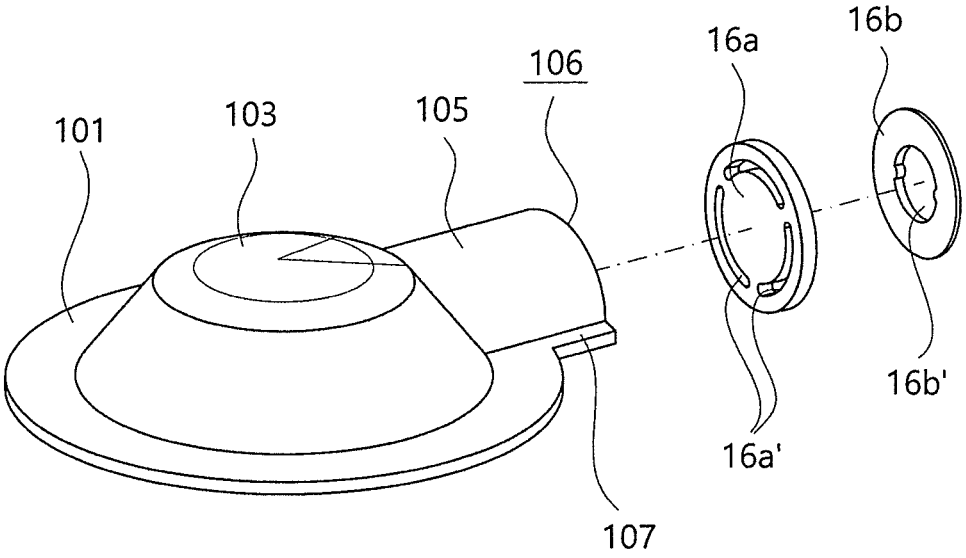
FIGS. 6A and 6B are a perspective view and a sectional view, respectively, illustrating configurations of the discharge guide and a check valve installed to be adjacent thereto according to the embodiment of FIG. 1.
Figure 6B:
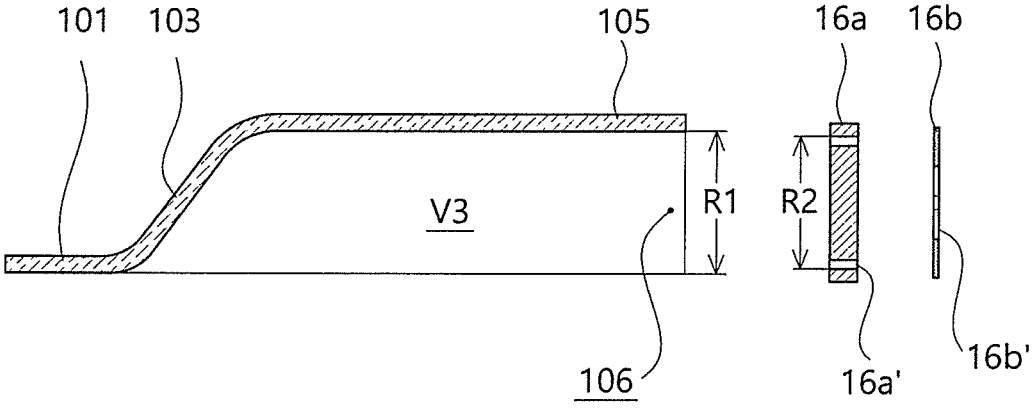

FIGS. 6A and 6B are a perspective view and a sectional view respectively illustrating configurations of the discharge guide 100 and the check valve 15 installed to be adjacent thereto according to the embodiment of the present disclosure. First, as for the configuration of the check valve 15, the check valve 15 is installed between an exit of the guide tunnel 105 and the entrance of the discharge pipe 14 facing the exit and prevents backflow (flow in a reverse direction of an arrow ③ of FIG. 4) of a refrigerant.

The check valve 15 may include two components, which are a valve body 16*a* and the valve plate 16*b*. The valve body 16*a* is closer to the guide tunnel 105 than the valve plate 16*b* and is fixed to the check valve. As illustrated in FIGS. 6A and 6B, valve holes 16*a*' are provided by being formed through the valve body 16*a* by surrounding a center thereof to allow a refrigerant to pass therethrough. In the embodiment, the valve holes 16*a*' may include a total of three valve holes along a circumferential direction of the valve body 16*a*.

The valve plate 16*b* is installed at the entrance of the discharge pipe 14 to move in a straight line, and when the valve plate is in close contact with the valve body 16*a*, the valve plate blocks each of the valve holes 16*a*' and prevents backflow of the refrigerant. The valve plate 16*b* may have a thin plate shape and a through hole 16*b*' provided at a center thereof. Accordingly, when the valve plate is spaced apart from the valve body 16*a*, the valve plate allows the refrigerant to pass therethrough, but when the valve plate is in close contact with the valve body 16*a*, the valve plate blocks the valve holes 16*a*'. More particularly, when a refrigerant flows in a normal direction (a direction of the arrow ③ of FIG. 4), the valve body 16*a* and the valve plate 16*b* are spaced apart from each other and thus the refrigerant sequentially passes through the valve holes 16*a*' and the through hole 16*b*' and is discharged to the outside. However, when a refrigerant reversely flows, the valve body 16*a* and the valve plate 16*b* come into close contact with each other and an edge of the valve plate 16*b* blocks the valve holes 16*a*', so that the flow of the refrigerant is prevented.

In the embodiment, a diameter R1 of the guide tunnel 105 of the discharge guide 100 is larger than a diameter R2 of a circle defined by the valve holes 16*a*' of the check valve 15 facing the guide tunnel. This allows a refrigerant to be efficiently discharged. Referring to FIG. 6, the diameter R1 of the exit of the guide tunnel 105 is compared with the diameter R2 of the circle defined by the valve holes 16*a*' of the check valve 15. Although the diameter R1 of the exit of the guide tunnel 105 is larger than the diameter R2 and the refrigerant leaks out to some degree to the dispersion space A, the refrigerant can be sufficiently discharged to the valve holes 16*a*' of the check valve 15. In the embodiment, the diameter R1 of the guide tunnel 105 is 19 mm to 22 mm, and the diameter R2 of the circle defined by the valve holes 16*a*' of the check valve 15 is 17 mm to 20 mm.

Figure 7:
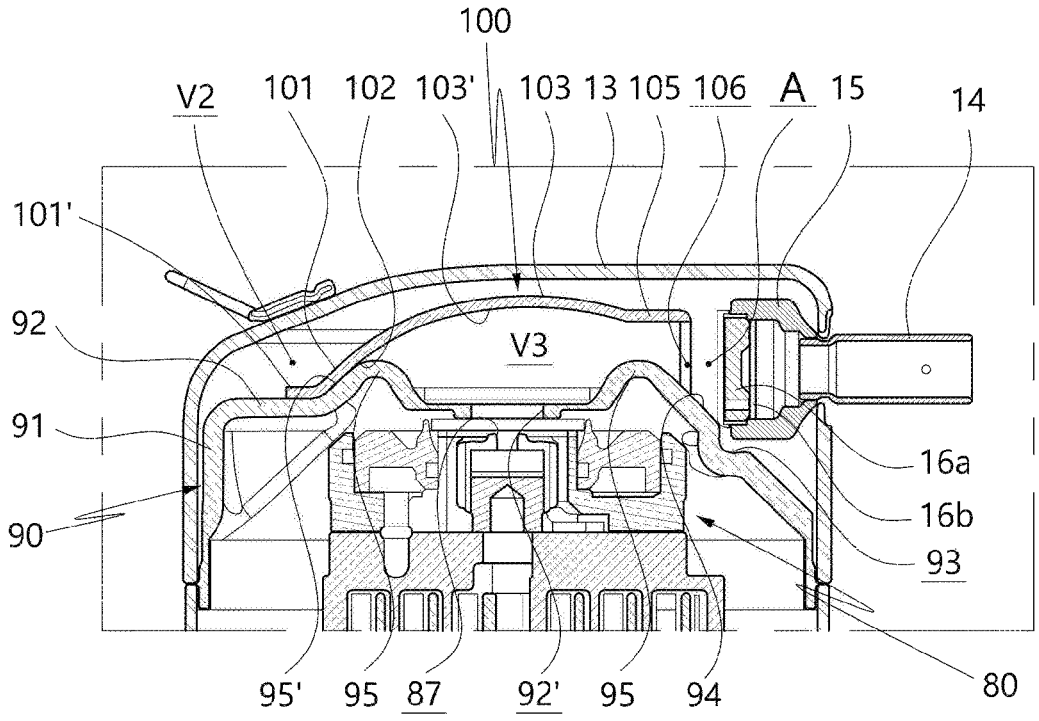
FIG. 7 is a sectional view illustrating an upper structure of the compressor according to another embodiment of the present disclosure.
Figure 8:
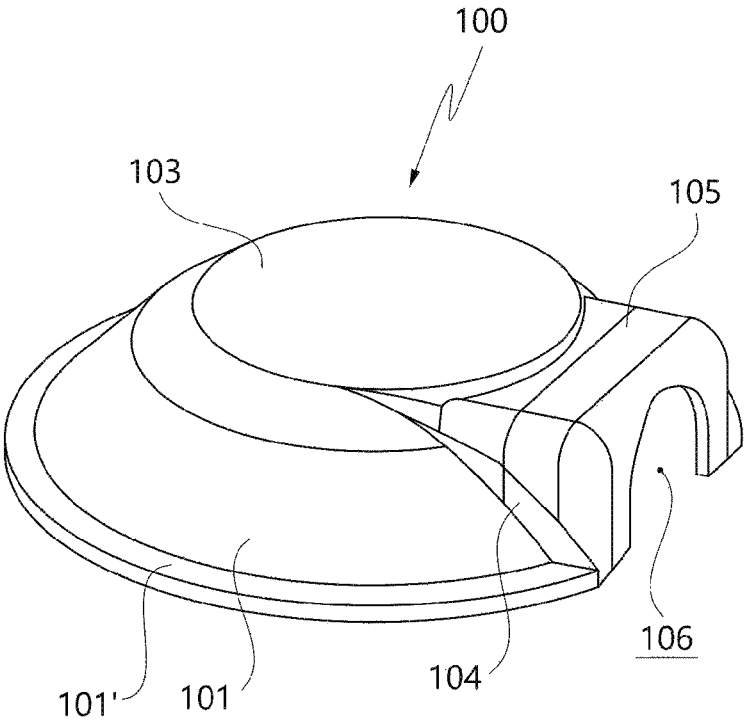
FIG. 8 is a perspective view illustrating configuration of a discharge guide according to the embodiment of FIG. 7.

Meanwhile, FIGS. 7 and 8 illustrate another embodiment of the present disclosure. Only structure and configuration different from the embodiment, which is described above, will be described and descriptions of the rest will be omitted by giving reference numerals to the components thereof.

As illustrated in FIG. 7, a reinforcement rib 95 is provided on the high/low pressure separation plate 90 by protruding therefrom. The reinforcement rib 95 may protrude upward from the high/low pressure separation plate 90 and have a circular shape by surrounding the communicating hole 92' relative thereto. A vicinity of the communicating hole 92' may have rigidity decreased due to the communicating hole 92', which is formed through the high/low pressure separation plate, and thus may be deformed by high pressure. The reinforcement rib 95 functions to prevent such a deformation by reinforcing the rigidity of the vicinity of the communicating hole 92'.

Meanwhile, as for the structure of the discharge guide 100, the discharge guide 100 may include a combination end 101. The combination end 101 is formed by surrounding a lower edge of the discharge guide 100 and is a part combined with the high/low pressure separation plate 90. The combination end 101 may be combined with the high/low pressure separation plate 90 by welding or by using an additional fastener such as a rivet. In the embodiment, the combination end 101 may have a roughly circular shape by surrounding the vicinity of the communicating hole 92' and a lower surface thereof may have a plane shape corresponding to the upper surface 92 of the high/low pressure separation plate 90.

In the embodiment, a portion of the combination end 101 may have a curved surface, which is bent to some degree, or an inclined surface instead of having a plane shape. This is because a part with which the combination end 101 is combined is the reinforcement rib 95 and the reinforcement rib 95 is configured to have a curved surface or an inclined surface. Accordingly, in response to this, the combination end 101 is also configured to have the curved surface or the inclined surface. Referring to FIG. 7, although an end part 101' of the combination end 101 has a plane section, a portion of the combination end 101 having a shape of the inclined surface 102 is combined with a portion of the inclined surface 95' of the reinforcement rib 95.

A guide body 103 is connected to the combination end 101. The guide body 103 extends by protruding upward from the combination end 101 and defines a guide room V3 at an inner side thereof. The guide body 103 defines the guide room V3 therein by protruding upward from the combination end and covering a communicating hole 92' of a high/low pressure separation plate 90.

In the embodiment, the guide body 103 of the discharge guide 100 protrudes toward a lower surface of the upper shell 13 of the casing with the communicating hole 92' of the high/low pressure separation plate 90 facing a center part thereof, wherein a height of the center part 103' provided by extending from the vicinity of the communicating hole 92' is configured to be the highest. That is, the guide body 103 may be referred to as having a kind of a dome shape. Such a dome shape allows a size of the guide room V3 to become large and prevents the lower surface of the guide body 103 from being deformed by the high pressure refrigerant discharged from the communicating hole 92'. That is, due to the dome structure, the guide body 103 may have increased durability against high pressure. As illustrated in FIG. 7, a height of a ceiling portion of the center part 103' facing the communicating hole 92' is the highest among inner surfaces of the guide body 103.

A guide tunnel 105 extends from a side of the guide body 103. A first side of the guide tunnel 105 is integrally connected to the guide body 103 and a second side of the guide tunnel, which is opposed to the first side, extends in a direction to the discharge pipe 14, so that the refrigerant is induced to the discharge pipe 14. As illustrated in FIG. 7, the guide tunnel 105 defines the connecting space 106 therein, wherein the connecting space 106 communicates with the guide room V3. That is, a side surface of the guide body 103 is open and communicates with the connecting space 106 of the guide tunnel 105. Fixing end parts 107 combined with the upper surface 92 of the high/low pressure separation plate 90 are provided at lower sides of the guide tunnel 105.

A width of the guide tunnel 105 is narrower than an entire width of the guide body 103, and due to such a shape, a refrigerant is guided to be concentrated in a specific direction, that is, toward the discharge pipe 14. In the embodiment, the guide tunnel 105 has a predetermined width and alternatively, may have a left to right width gradually narrowing toward an end part thereof to the discharge pipe 14, or may have a height gradually lowering toward the discharge pipe 14.

The guide body 103 and the guide tunnel 105 are configured to have a continuous curved or inclined surface. In the embodiment, the guide body 103 may naturally extend from the combination end 101 to have a shape of a curved surface and may entirely have the curved surface to an upper portion of the guide body. As illustrated in FIG. 8, when the guide tunnel 105 is seen from a direction of an exit of the connecting space 106, the guide tunnel 105 may have a roughly semi-circular shape and accordingly, an outer surface thereof may have a curved surface structure. Furthermore, a connection part 104 connecting the guide body 103 with the guide tunnel 105 also may have a shape of an inclined surface or a curved surface.

Accordingly, as the entirety of the discharge guide 100 is configured to have a structure of a curved surface or an inclined surface, there is no dead space in the guide room V3 and the connecting space 106 of the inner part of the discharge guide, and vortices, which may be caused by an edge structure, can be prevented. Furthermore, the structure having such a curved surface or inclined surface prevents stress from being concentrated on the discharge guide 100 and thus also functions to enhance durability. Since the refrigerant discharge space V2 is basically filled with high pressure refrigerants, the discharge guide 100 is strongly pressed. However, the structure of the curved surface or the inclined surface of the discharge guide 100 enhances durability thereof such that the discharge guide is prevented from being deformed.

Even in the embodiment, the guide tunnel 105 of the discharge guide 100 is spaced apart from the discharge pipe 14. Since the guide tunnel 105 is spaced apart from the discharge pipe 14 without being directly connected thereto, there is a dispersion space A therebetween. A portion of a refrigerant passing through the guide tunnel 105 may escape through the dispersion space A, or contrarily, a refrigerant in the refrigerant discharge space V2 may be introduced into the dispersion space A. In the embodiment, the dispersion space A may have a 3 mm to 6 mm width and have the same width in a vertical direction. Of course, such a width may be differently set according to a height of the dispersion space.

The dispersion space A disperses a portion of a refrigerant and accordingly, prevents noise in the discharge pipe 14 which may occur due to the refrigerant rapidly flowing only along the discharge guide 100 into the discharge pipe 14. More particularly, when the refrigerant is concentrated all at once, the valve plate 16*b*, which constitutes the check valve 15 of the discharge pipe 14, may move at a high speed and generate noise inside the discharge pipe 14. However, the noise is prevented to some extent by the dispersion space A.

Next, a discharge process of a refrigerant will be described referring to FIG. 4. A refrigerant is in a state of high temperature and high pressure by being compressed in the compression unit 50 and is discharged through the discharge hole 67 of the fixed scroll 60. The discharge hole 67 communicates with the back pressure hole 87 of the back pressure assembly 80 installed at an upper part of the discharge hole and with the communicating hole 92' of the high/low pressure separation plate 90 laminated on the back pressure hole. Accordingly, the refrigerant passes through the holes in a direction of an arrow ① of FIG. 4 and is discharged to the inner side of the discharge guide 100.

The refrigerant is discharged to the guide room V3 positioned at the inner side of the discharge guide 100. That is, the refrigerant is not directly discharged to the refrigerant discharge space V2, but first gathers in the guide room V3. Next, the refrigerant flows along the guide tunnel 105 extending to a side of the guide room V3 along a direction of an arrow ②.

Since the guide tunnel 105 faces the discharge pipe 14, the refrigerant is naturally directed along the direction of the arrow ③ to the discharge pipe 14 and is finally discharged to the outside. In this case, since the diameter R1 of the guide tunnel 105 of the discharge guide 100 is larger than the diameter R2 of the circle defined by the valve holes 16*a*' of the check valve 15 opposed thereto, the refrigerant is efficiently discharged. Accordingly, the discharge guide 100 constituting the present disclosure defines a continuous flow path from the communicating hole 92' connected to the compression chamber to the entrance of the discharge pipe 14. Accordingly, the refrigerant is naturally discharged.

Meanwhile, there is the dispersion space A between the guide tunnel 105 and the discharge pipe 14. Accordingly, a portion of the refrigerant passing through the guide tunnel 105 may escape through the dispersion space A, or contrarily, a refrigerant in the refrigerant discharge space V2 may be introduced into the dispersion space A. The arrow ④ of FIG. 4 indicates flow of the portion of the refrigerant caused by the dispersion space A.

The dispersion space A disperses a portion of a refrigerant and accordingly, prevents noise in the discharge pipe 14 which may occur due to the refrigerant rapidly flowing only along the discharge guide 100 into the discharge pipe 14. More particularly, when the refrigerant is concentrated all at once, the valve plate 16*b*, which constitutes the check valve 15 of the discharge pipe 14, may reciprocate at a high speed and generate noise inside the discharge pipe 14. However, the noise is prevented to some extent by the dispersion space A.

In addition, the portion of the refrigerant escaping through the dispersion space A gathers in the refrigerant discharge space V2 and again may be discharged through the dispersion space A to the discharge pipe 14. Although the high temperature and pressure refrigerant gathers in the refrigerant discharge space V2, a majority of the refrigerant is guided to the discharge pipe 14 by the discharge guide 100. Accordingly, the refrigerant discharge space V2 is prevented from being excessively heated or from being maintained at high pressure.

Accordingly, temperature of an entire inner part of the compressor including a lower part thereof is decreased and thus the input value (power consumption) of the compressor is decreased. Accordingly, efficiency of the compressor is improved and is prevented the high/low pressure separation plate 90 from being deformed by high pressure.

In addition, the discharge guide 100 is combined with the high/low pressure separation plate by covering the vicinity of the communicating hole 92' in which rigidity of the high/low pressure separation plate 90 is relatively low. Accordingly, the discharge guide 100 reinforces the rigidity of the high/low pressure separation plate 90 and prevents the high/low pressure separation plate 90 from being deformed by the high pressure refrigerant.

According to the present disclosure, the input value (the power consumption) of the compressor is decreased by around 0.4% to 0.9%, and accordingly, the efficiency of the compressor is increased by 1.2% to 2.0%. Furthermore, the temperature of the entire inner part of the compressor is also decreased. When the compressor of the present disclosure is compared with a compressor without the discharge guide 100, (i) temperature of the entrance of the check valve 15 is decreased by 0.5°, (ii) temperature of the inner part of the upper shell 13, that is, temperature of the inner part of the refrigerant discharge space V2 is decreased by 3.1°, (iii) temperature of the vicinity of the communicating hole 92' is decreased by 5.2°, and (iv) temperature of a vicinity of the lower frame 18, which is a lower end part of the compressor, is decreased by 2.5°. This is because the inner part of the refrigerant discharge space V2 is prevented from being excessively heated and the heat of the refrigerant discharge space V2 is prevented from being transmitted to the refrigerant inlet space V1.

In the foregoing description, the present disclosure is not necessarily limited to these embodiments, although all of the components constituting the embodiments according to the present disclosure are described as being combined or operating in combination. That is, as long as it is within the scope of the present disclosure, all of the components may operate selectively in combination with at least one of them. In addition, the terms "include", "comprise", or "have" described above mean that the corresponding components may be included unless otherwise stated. Accordingly, it should be construed that other components are not excluded, but may be included. All terms, including technical and scientific terms, have the same meaning as commonly understood by those having ordinary skills in the art unless otherwise defined. Terms commonly used, such as terms defined in a dictionary, should be interpreted to coincide with the contextual meaning of the related art, and shall not be construed in an ideal or overly formal sense unless explicitly defined in the present disclosure.

Although preferred embodiments of the present disclosure have been described for illustrative purposes, those skilled in the art will appreciate that various modifications, additions and substitutions are possible, without departing from the scope and spirit of the disclosure as disclosed in the accompanying claims. Accordingly, the embodiments disclosed in the present disclosure are not intended to limit the technical idea of the present disclosure but to describe the present disclosure, and the scope of the technical idea of the present disclosure is not limited by these embodiments. The scope of protection of the present disclosure should be interpreted by the following claims, and all technical ideas within the scope equivalent thereto should be construed as being included in the scope of the present disclosure.

What is claimed is:

1. A compressor, comprising:

a casing to which a suction pipe through which a refrigerant is suctioned into the casing and a discharge pipe through which the refrigerant is discharged from the casing are connected;

a compression unit provided in the casing and that compresses the refrigerant while rotating using a rotational force of a drive unit transmitted by a rotational shaft;

a high/low pressure separation plate that crosses an upper portion of the compression unit, wherein the high/low pressure separation plate partitions a refrigerant inlet space that communicates with the suction pipe and a refrigerant discharge space that communicates with the discharge pipe; and a discharge guide provided in the refrigerant discharge space, the discharge guide being coupled with an upper surface of the high/low pressure separation plate and at least a portion thereof extending to the discharge pipe so as to cover a communication hole of the high/low pressure separation plate which allows the refrigerant inlet space and the refrigerant discharge space to communicate with each other, so that the refrigerant discharged to the refrigerant discharge space is guided to the discharge pipe, wherein the discharge guide is provided with a guide tunnel that extends in a direction to the discharge pipe such that the refrigerant in a guide room is guided to the discharge pipe, wherein a lower portion of the guide tunnel is open to the upper surface of the high/low pressure separation plate, and wherein an inclined portion that connects an end of the guide tunnel with an entrance of the discharge pipe is provided on the upper surface of the high/low pressure separation plate equivalent to the lower portion of the guide tunnel.

2. The compressor of claim 1, wherein the discharge guide includes:

a combination end coupled with the upper surface of the high/low pressure separation plate by surrounding the communication hole of the high/low pressure separation plate;

a guide body connected to the combination end and defining the guide room therein by protruding upward from the combination end and covering the communication hole of the high/low pressure separation plate; and the guide tunnel connected to the guide body.

3. The compressor of claim 2, wherein the guide tunnel of the discharge guide and the discharge pipe are spaced apart from each other and a dispersion space is provided therebetween.

4. The compressor of claim 2, wherein a distance between the guide tunnel of the discharge guide and the discharge pipe forming a dispersion space is 1%~4% of a value of an area of the guide tunnel.

5. The compressor of claim 2, wherein the guide body of the discharge guide protrudes to have a width gradually narrowing upward and a portion of a side surface of the guide body is open and is connected to the guide tunnel.

6. The compressor of claim 2, wherein the guide body has a shape of a cap having a lower portion of a circular shape and protrudes upward such that a side surface of the guide body has a width gradually narrowing upward.

7. The compressor of claim 2, wherein a shape of a transverse section of the guide tunnel includes an upper section of an arc or elliptical arc shape and a lower section straightly extending from each of opposite ends of the upper section toward the high/low pressure separation plate.

8. The compressor of claim 2, wherein the guide body of the discharge guide protrudes toward a lower surface of an upper shell of the casing with the communication hole of the high/low pressure separation plate facing a center portion thereof, and wherein a height of the center portion provided by extending from a vicinity of the communication hole is configured to be highest.

9. The compressor of claim 2, wherein a width and a height of the guide tunnel are smaller than a width and a height of the guide body.

10. The compressor of claim 2, wherein the guide body and the guide tunnel are provided as a continuous curved or inclined surface.

11. The compressor of claim 2, wherein a diameter of the guide tunnel of the discharge guide is larger than a diameter of a circle defined by valve holes of a check valve opposed thereto.

12. The compressor of claim 2, wherein the combination end coupled with the high/low pressure separation plate protrudes from a lower end of the discharge guide, wherein fixing end parts coupled with the high/low pressure separation plate protrude from a lower end of the guide tunnel, and wherein the combination end and the fixing end parts are continuously connected to each other.

13. The compressor of claim 2, wherein a reinforcement rib having a circular shape is provided on the high/low pressure separation plate and surrounds the communication hole and protrudes upward from the high/low pressure separation plate, and wherein the combination end of the discharge guide is coupled with an outer surface of the reinforcement rib.

14. The compressor of claim 13, wherein the combination end is coupled with the upper surface of the high/low pressure separation plate or the reinforcement rib by welding or a fastener.

15. The compressor of claim 2, wherein a check valve is provided at an entrance of the discharge pipe facing an exit of the guide tunnel, wherein the check valve includes:

a valve body having valve holes that extend through the valve body and surround a center thereof; and a valve plate provided at the entrance of the discharge pipe to move in a straight line and block the valve holes when the valve plate is in close contact with the valve body.

16. A compressor, comprising:

a casing to which a suction pipe through which a refrigerant is suctioned into the casing and a discharge pipe through which the refrigerant is discharged from the casing are connected;

a compression unit provided in the casing and that compresses the refrigerant while rotating using a rotational force of a drive unit transmitted by a rotational shaft;

a high/low pressure separation plate that crosses an upper portion of the compression unit, wherein the high/low pressure separation plate partitions a refrigerant inlet space that communicates with the suction pipe and a refrigerant discharge space that communicates with the discharge pipe; and a discharge guide provided in the refrigerant discharge space, the discharge guide being coupled with an upper surface of the high/low pressure separation plate and at least a portion thereof extending to the discharge pipe so as to cover a communication hole of the high/low pressure separation plate which allows the refrigerant inlet space and the refrigerant discharge space to communicate with each other, so that the refrigerant discharged to the refrigerant discharge space is guided to the discharge pipe, wherein the discharge guide is provided with a guide tunnel that extends in a direction to the discharge pipe such that the refrigerant in a guide room is guided to the discharge pipe, and wherein a distance between the guide tunnel of the discharge guide and the discharge pipe forming a dispersion space is 1%~4% of a value of an area of the guide tunnel.

17. The compressor of claim 16, wherein the discharge guide includes:

a combination end coupled with the upper surface of the high/low pressure separation plate by surrounding the communication hole of the high/low pressure separation plate;

a guide body connected to the combination end and defining the guide room therein by protruding upward from the combination end and covering the communication hole of the high/low pressure separation plate; and the guide tunnel connected to the guide body.

18. The compressor of claim 17, wherein the guide body of the discharge guide protrudes to have a width gradually narrowing upward and a portion of a side surface of the guide body is open and is connected to the guide tunnel.

19. The compressor of claim 17, wherein the guide body has a shape of a cap having a lower portion of a circular shape and protrudes upward such that a side surface of the guide body has a width gradually narrowing upward.

20. The compressor of claim 17, wherein a shape of a transverse section of the guide tunnel includes an upper section of an arc or elliptical arc shape and a lower section straightly extending from each of opposite ends of the upper section toward the high/low pressure separation plate.

* * * * *